United States Patent [19]

Forest

[11] 4,209,962

[45] Jul. 1, 1980

[54] SAFETY STIRRUP HAVING A SWINGAWAY FOOTREST RELEASED BY TOE-ACTUATED DEFLECTOR PLATES

[76] Inventor: Roger C. Forest, 9880 Meridian South, Puyallup, Wash. 98371

[21] Appl. No.: 943,115

[22] Filed: Sep. 18, 1978

[51] Int. Cl.[2] ..... B68C 3/02

[52] U.S. Cl. ..... 54/49

[58] Field of Search ..... 54/49, 49.5, 48, 47

[56] References Cited

U.S. PATENT DOCUMENTS

| | | | |
|---|---|---|---|
| 153,074 | 7/1874 | Harris | 54/49 |
| 346,174 | 7/1886 | Shearer | 54/49 |
| 358,603 | 3/1887 | Gibson | 54/49 |
| 475,374 | 5/1892 | Anderson | 54/49 |
| 545,796 | 9/1895 | Haddorf et al. | 54/49 |
| 665,884 | 1/1901 | Davis et al. | 54/49 |
| 895,971 | 8/1908 | Curns | 54/49 |
| 898,683 | 9/1908 | Riley | 54/49 |
| 902,397 | 10/1908 | Hall | 54/49 |
| 933,958 | 9/1909 | Carter | 54/49 |
| 982,810 | 1/1911 | Graham | 54/49 |
| 1,007,247 | 10/1911 | Sipes | 54/49 |
| 1,062,125 | 5/1913 | Sipes | 54/49 |
| 1,087,503 | 2/1914 | Neidigh | 54/49 |
| 1,111,731 | 9/1914 | Boyd et al. | 54/49 |
| 1,276,819 | 8/1918 | Sklar | 54/49 |
| 1,392,673 | 10/1921 | Baker | 54/49 |

*Primary Examiner*—Hugh R. Chamblee

*Attorney, Agent, or Firm*—Christensen, O'Connor, Johnson & Kindness

[57] ABSTRACT

The safety stirrup disclosed herein has a strap receiving hanger bar at the upper extent of the stirrup, and a pair of laterally spaced apart side bars that depend downwardly from the hanger bar, wherein one of the side bars is pivotally connected to the hanger bar so as to be swingable, laterally outwardly with respect to the opposite side bar. One end of a footrest bar that normally bridges the lower ends of the side bars is pivotally connected to the lower end of the nonpivoted side bar, and the opposite end of the footrest bar is held by a releasable catch formed on the lower end of the pivoted side bar. A biasing spring continuously urges the pivotally mounted side bar inwardly so as to cause the catch at its lower end to retain the footrest bar in a bridging, foot supporting position. A pair of deflector plates are separately affixed, one to each side bar, and are shaped as to be forwardly and upwardly convergent so as to react to excessive, upward tilting of the boot toe of a falling rider which wedges between the deflector plates, spreading the plates and thus the supporting side bars, laterally outwardly. The resulting displacement of the lower end of the pivotally mounted side bar releases the catch that retains the footrest bar and allows the footrest bar to swing downwardly and away, safely releasing the rider's boot and foot.

11 Claims, 5 Drawing Figures

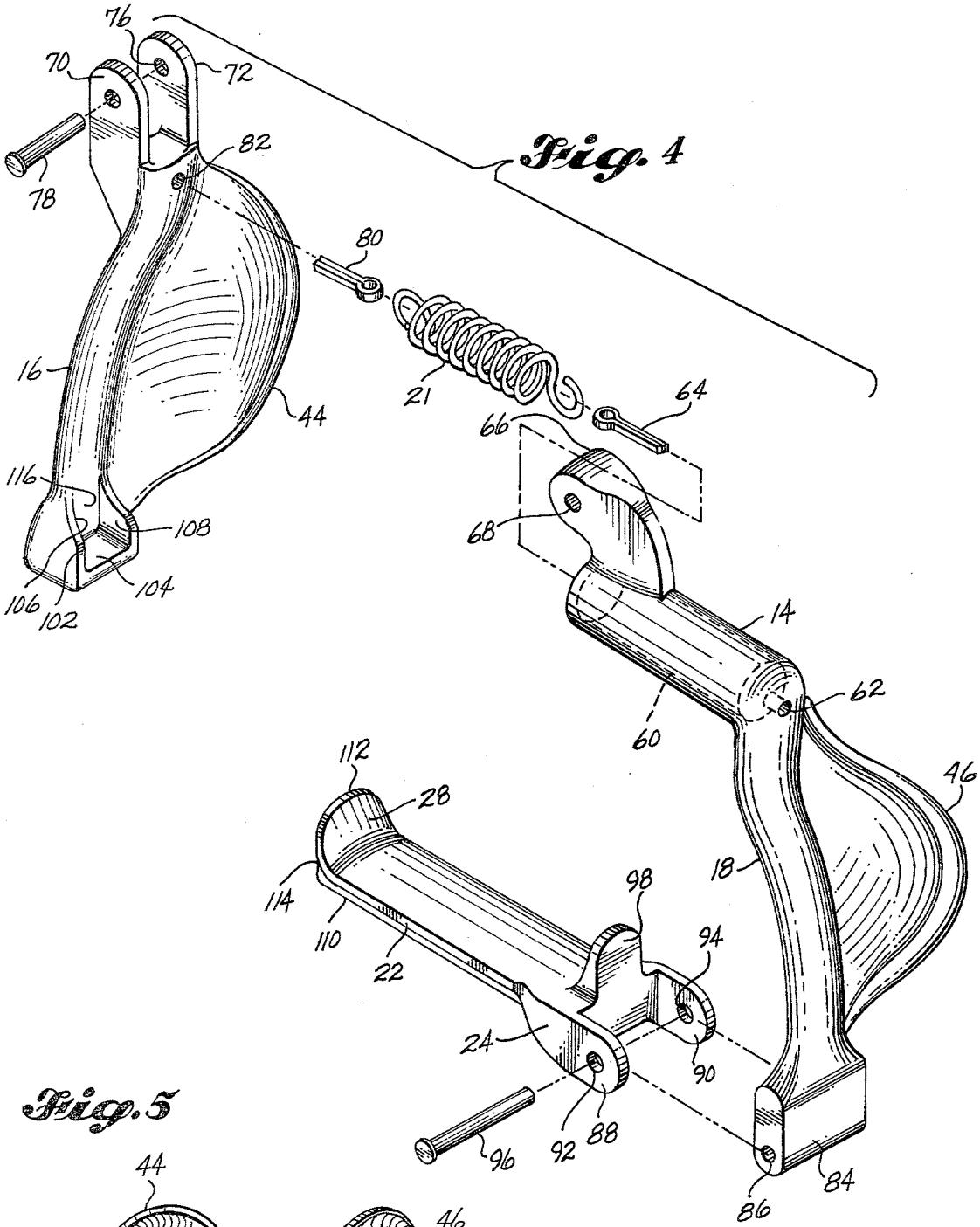
Fig. 4
Fig. 5
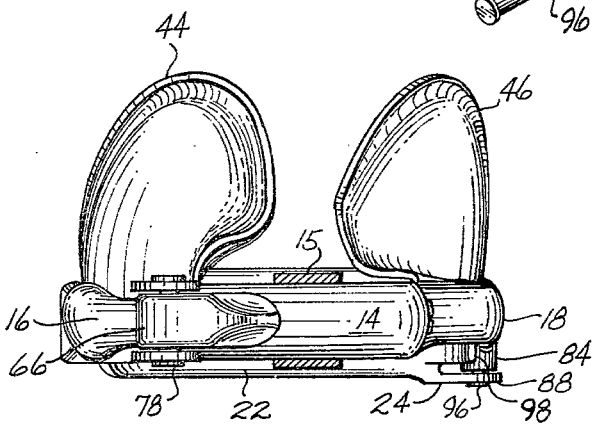

SAFETY STIRRUP HAVING A SWINGAWAY FOOTREST RELEASED BY TOE-ACTUATED DEFLECTOR PLATES

BACKGROUND OF THE INVENTION

The invention relates to safety stirrups and more particularly to the type of safety stirrup that has a swingaway footrest bar which is normally held in a foot supporting position, bridging the lower ends of the stirrup side bars, and is released by excessive upward tilting of the rider's boot toe, which is anticipated to occur when a rider falls or is thrown from a horse.

It has long been known that horseback riders face a dangerous risk of one of their booted feet becoming entangled in a stirrup when thrown by or accidently falling from a horse. The conventional stirrup, including its rigid, steel hoop, does not always slip off the rider's boot during a fall, and, of course, if the foot remains held by a stirrup, and the horse bolts or continues to run, resulting injuries to the rider can be severe and possibly fatal.

In light of this long known danger, there have been numerous prior efforts to develop a stirrup that functions in the usual manner during normal riding conditions, and that releases automatically in reaction to abnormal pressures exerted by tilting or rotation of the rider's boot associated with a fall. Previous attempts to design a safety stirrup have not been widely accepted. One common shortcoming of prior safety stirrups has been their complexity and the resulting, excessive manufacturing cost. Examples of overly complex, prior art safety stirrups include those disclosed in U.S. Pat. No. 1,392,673 issued to Baker, U.S. Pat. No. 1,062,125 issued to Sipes, and U.S. Pat. No. 545,796 issued to Haddorf and Eggers.

Other prior art safety stirrups may have been simpler to manufacture, but on the other have have not provided the high degree of reliability and durability demanded of such a safety device. For example, in U.S. Pat. No. 358,603 issued to Gibson, a relatively simple stirrup mechanism is disclosed in which the side bars of the stirrup are pivotally joined so as to be forced apart by the boot of a falling rider, which thereby effects a release of a catch normally retaining the lower end of one side bar connected to the adjacent end of the footrest bar. But, the forces needed to spread the side bars in the Gibson patent do not always result from the displacement of the rider's boot that can be expected from a fall. Normally, the boot of a falling rider will tilt about a pivot at the footrest bar, with the toe of the boot being forced upwardly and the heel downwardly, and/or turned to the side with the toe being forced into or away from the side of the horse. The resulting movement of the boot does not insure that the side bars in the Gibson stirrup will be forced outwardly, as needed to release the footrest bar. Moreover, the one end of the Gibson footrest bar is rigidly and integrally joined to one of the side bars such that the rider's boot may still become wedged between the top of the stirrup hoop and the rigidly affixed footrest bar, even though the pivotally mounted side bar has been released and has swung outwardly.

In another type of safety stirrup, as exemplified by U.S. Pat. No. 933,958 issued to Carter, an upwardly actuated trip lever is disposed beneath the strap receiving hanger bar, so as to be triggered by a displacement of the rider's boot. It is designated such that the instep of the boot presses upwardly against the trip lever at the top of the stirrup. However, if the toe of the boot turns to the side of the stirrup during the rider's fall, the boot could still hang up in the stirrup without actuating the trip lever. Another example of this type of safety stirrup is disclosed in U.S. Pat. No. 475,374 issued to Anderson.

In still aother type of safety stirrup, the disposition of the trip mechanism is such that it is intended to be upwardly actuated by the boot, as above. However, this placement of the trip lever does not take into account the most likely movement of the boot, namely the above-mentioned upward tilting of the rider's toe, pivoting about the footrest. The resulting force on the trip lever is askew to the movement of the lever, thereby increasing the probability of the trip lever jamming and failing to release the rider's boot. U.S. Pat. No. 898,683 issued to Riley and U.S. Pat. No. 1,276819 issued to Sklar show versions of this type of stirrup in which the trip lever is mounted for upward travel between the side bars of the stirrup.

Accordingly, it is an object of the invention to provide a safety stirrup that will reliably release the rider's boot under every possible, abnormal orientation of the rider's boot that might occur during a fall and yet not inadvertently release under normal riding conditions, and that is durable under the environmental conditions associated with horseback riding, and that is composed of a few number of readily producible and easily assembled components so as to be capable of mass manufacture at a relatively low per unit cost relative to other safety stirrups of comparable reliability and durability.

SUMMARY OF THE INVENTION

The improved safety stirrup of the invention has a pair of generally earshaped deflector plates separately affixed to first and second side bars of the stirrup which in turn are connected so as to be swingable, laterally outwardly relative to each other for releasing a swingaway footrest bar that is normally retained in a foot supporting position bridging the lower ends of the side bars. In the normal, nonreleased configuration of the stirrup, biasing means forces the side bars and deflector plates supported thereby, inwardly to a predetermined, minimum space relation at which the footrest bar spans the lower ends of the side bars and is held in that position by a releasable catch at the lower end of one side bar. The deflector plates project forwardly from the side bars of the stirrup and are contoured in a forwardly and upwardly convergent configuration devised so that excessive upward tilting and/or turning (in or out) of the toe of a rider's boot exerts a force on the deflector plates that tends to spread the side bars laterally outwardly. The resulting separation force, acting on the side bars works against the bias tending to hold the side bars inwardly, and as the bias is overcome, the side bars separate, releasing the catch and enabling the footrest bar to swing downwardly and away and thus release the rider's boot and foot.

In a preferred form of the invention, the stirrup is provided with a strap receiving hanger bar that extends in elevated, parallel relation to the footrest bar and that supports at its opposite ends, the downwardly depending side bars. The same side bar that is formed at its lower end with the catch for engaing the footrest bar is pivotally connected to the hanger bar to provide the above-mentioned laterally outward swingable movement with respect to the opposite side bar. And the hanger bar is of tubular shape and houses there within a biasing spring that serves as the above-mentioned bias for continuously urging the side bars inwardly to the nominal separation at their lower ends.

To provide a complete disclosure of the invention, references made to the attached drawings and the following description of one particular and preferred embodiment.

BRIEF DESCRIPTION OF THE DRAWINGS

FIG. 4 is an exploded perspective view of the safety stirrup of FIG. 1.

FIG. 5 is a top plan view of the safety stirrup of FIG. 1.

DETAILED DESCRIPTION

Figure 1:
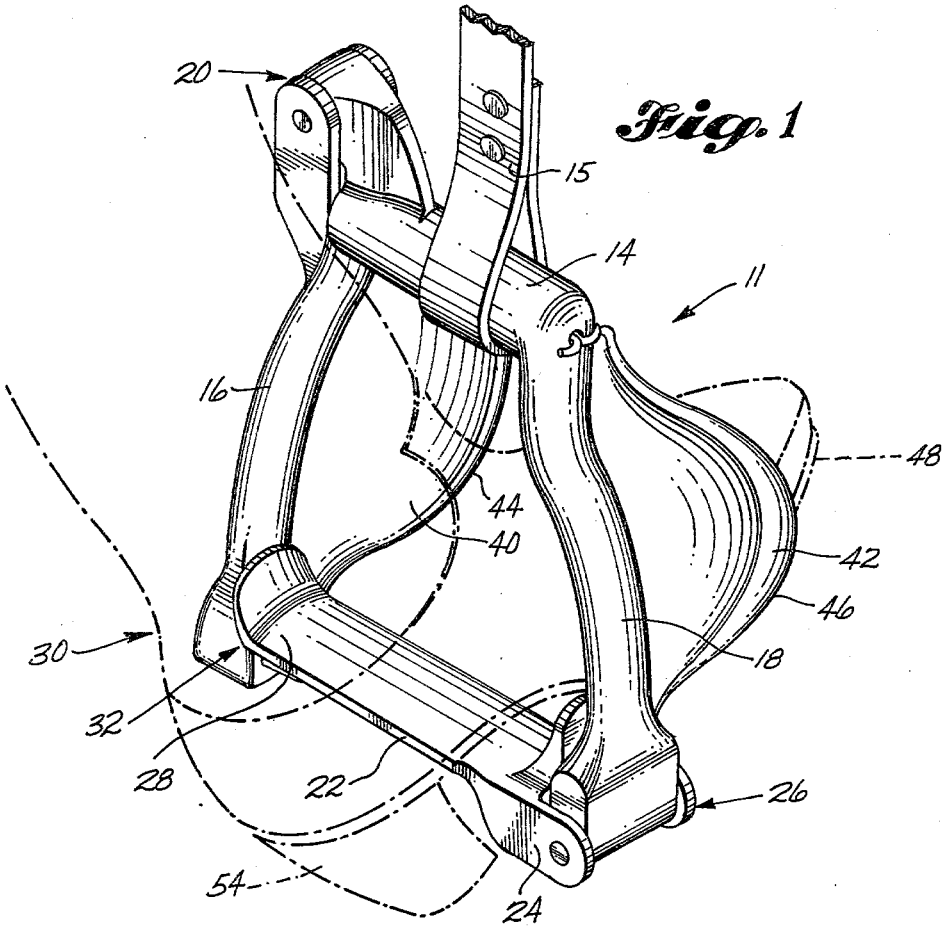
FIG. 1 is a perspective view of the safety stirrup of the invention, shown in a normal, nonreleased condition.

With reference to FIG. 1, the improvements provided by the present invention are embodied in a safety stirrup 11 which is shown to include a strap receiving hanger bar 14, looped by a stirrup strap 15, and a pair of laterally spaced apart side bars 16 and 18 which depend downwardly from opposite ends of hanger bar 14 and define together therewith an inverted U-shaped body portion of the stirrup. An upper end of side bar 16 is swingably attached to the adjacent end of bar 14 by a pivotal connection 20 that allows side bar 16 to swing laterally outwardly away from the opposite side bar 18. A footrest bar 22 normally bridges the lower ends of side bars 16 and 18 and is swingably attached at one end 24 to the lower end of side bar 18 by a pivotal connection 26 that allows the opposite end 28 of bar 22 to swing downwardly and away from side bar 16 to free the rider's boot 30, which is shown in phantom. End 28 of a footrest bar 22 is normally retained in a foot supporting, nonreleased position with respect to side bar 16 by a catch 32, cooperatively formed by engaging portions of end 28 of bar 22 and the lower end of side bar 16. Hanger bar 14 has a hollow interior housing a biasing spring 21 (as best shown in FIG. 2) that biases side bar 16 inwardly to a minimum lateral spacing relative to side bar 18 at which catch 32 retains end 28 of footrest bar 22 in the nonreleased position.

Affixed along the forward edge surfaces of side bars 16 and 18 are a pair of generally ear-shaped deflector plates 40 and 42, respectively, which project forwardly from bars 16 and 18 to forwardmost terminal edges 44 and 46 of roughly semicircular shape. Deflector plates 40 and 42 are contoured so as to be forwardly and upwardly convergent. The resulting shapes of deflector plates 40 and 42 form, together with footrest bar 22, an open region of generally triangular shape as viewed in FIGS. 2 and 5, into which the toe 48 of boot 30 is inserted and retained during normal riding conditions. The forwardly and upwardly oriented convergence of plates 40 and 42 locates their forwardmost edges 44 and 46 in a position for being contacted by and deflected outwardly should the boot toe 48 become tilted upwardly and/or turned inwardly or outwardly by an excessive degree, such as will occur during a fall. As descirbed more fully hereinafter, this deflection of plates 40 and 42 causes the side bars to spread and thereby release catch 32 causing footrest bar 22 to release the rider's boot.

Figure 2:
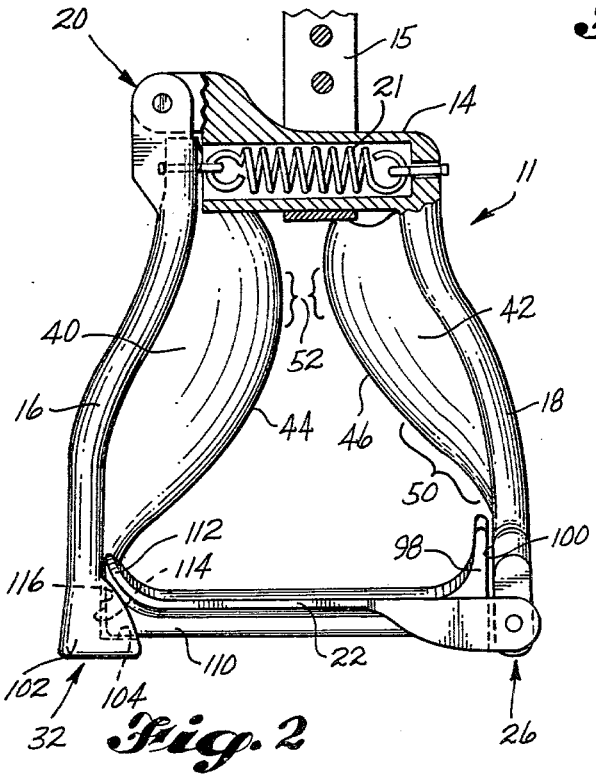
FIG. 2 is an elevation view, partly in section, of the safety stirrup of FIG. 1.

As best shown in FIG. 2, deflector plates 40 and 42 are slightly assymetrical in configuration to accommodate the normal positioning of a rider's boot over to the side of the stirrup that lies adjacent the side of the horse. In particular, stirrup 11 is constructed so that it is worn with the pivotally attached side bar 16 on the outside, away from the body of the horse, while side bar 18 lies against the horse's side. Oriented as such, deflector plate 42 is formed with less inward convergence in the region indicated by reference numeral 50, adjacent footrest bar 22, compared to deflector plate 40 to enable the rider to position his foot and boot as close as usual to side bar 18 and thus to the horse's side. Additionally, the described positioning of stirrup 11 leaves side bar 16 free (without interference from the side of the horse or saddle) to swing outwardly as required to release footrest bar 22.

To provide a smooth, reliable camming action between the forward foot portion of boot 30 and plates 40 and 42, the edges 44 and 46 thereof are turned smoothly outwardly as best shown in FIG. 4. Also with his same objective, edges 44 and 46 form smooth, continuous curves commencing at the junctions with the lower ends of side bars 16 and 18 and first extending forwardly and only slightly upwardly and inwardly, and then more sharply upwardly and inwardly at a greater curvature to a maximum forward projection approximately at midheight between footrest bar 22 and hanger bar 14. Then edges 44 and 46 continue upwardly but reverting rearwardly to a region indicated by reference number 52 of minimum lateral spacing, and finally turning laterally outwardly and continuing rearwardly back to the juncture with the upper ends of the associated side bars 16 and 18. The forwardmost extent of edges 44 and 46 should reach to approximately ½ to ¾ of the length of the forward portion of boot 30 between the forward extent of heel 54 and toe 48.

With reference to FIG. 4, hanger bar 14 has a tubular configuration defining an interior cylindrical chamber 60 open at the end adjacent side bar 16. At the opposite end, bar 14 is integrally formed with the upper end of side bar 18 and the associated end of chamber 60 is closed except for a small, concentric through bore 62. Spring 21 is a helical tension spring sized to fit coaxially within bore 60 with the end of spring 21 adjacent side bar 18 being anchored by an eye of a cotter pin 64, the legs of which are inserted through bar 62 from the interior of chamber 60 and spread on the outside of side bar 18 (see FIG. 1).

Pivotal connection 20 is provided by an upwardly and outwardly projecting lug 66 integrally formed on the upper surface of bar 14 adjacent the end thereof that receives side bar 16. A bore 68 extends through lug 66 in a direction lying perpendicularly to the principal plane of the stirrup. The upper end of side bar 16 is bifurcated to provide a pair of upwardly projecting, spaced parallel ears 70 and 72 sized to straddle lug 66 and having through bores 74 and 76 alignable with bore 68 on lug 66. A pivot pin 78 is insertable into bores 74, 68 and 76 whereafter it is peened over at the opposed ends to permanently secure ears 70 and 72 to lug 66. With side bar 16 so assembled the free end of spring 21 is attached to side bar 16, below pivot pin 78, with a cotter pin 80, the legs of which are inserted through a bore 82 provided in side bar 16 in alignment with the axis of chamber 60 in bar 14. Spring 21 is thus housed inside hanger bar 14 to protect the spring action from malfunction due to dirt, grit and other damaging environmental conditions normally encountered in horseback riding.

With further reference to FIG. 4, pivotal connection 26 (refer to FIG. 1) is provided by an enlarged lower end portion 84 on side bar 18, which in turn has a bore 86 passing therethrough, along a direction perpendicular to the above-mentioned plane of the stirrup. Cooperating with enlarged end portion 84, are a pair of spaced parallel ears 88 and 90 of a bifurcated end 24 of footrest bar 22. Ears 88 and 90 straddle end portion 84 of bar 18, and bores 92 and 94 provided on ears 88 and 90, respectively, are aligned with bore 86. A pivot pin 96 is passed through bores 88, 90 and 86 and then peened over at its opposite ends to complete pivotal connection 26.

End 24 of bar 22 is further formed with a stop lug 98 that projects generally upwardly adjacent ears 88 and 90 to provide a stop that contacts an inwardly facing abutment surface 100 on side bar 18 for limiting the upward swingable movement of bar 22 to a horizontal position as shown in FIG. 2, parallel to hanger bar 14.

Catch 32 (see FIGS. 1 and 2) is best described by referring to FIG. 4 wherein, the lower end of side bar 16 is shown to be formed with a generally channel-shaped portion 102 that projects for a short distance inwardly toward side bar 18 and has a bottom wall 104 and a pair of side walls 106 and 108. The cooperating end of footrest bar 22 has a lower rib 110 mated at the end 28 to seat in channel-shaped portion 102. An upturned end portion 112 or bar 22 forms a stop surface 114 (see FIG. 2) that contacts an inwardly facing abutment surface 116 on side bar 16 to limit the inward swingable movement of side bar 16 relative to side bar 18 to the nominal separation when footrest bar 22 is swung upwardly to the horizontal positions as illustrated in FIG. 2. Thus, when stirrup 11 is in the non-released condition, as shown in FIG. 2, bottom wall 104 of channel-shaped portion 102 forms an upper surface that is parallel to the lengthwise axis of bar 22 and is thus parallel to the lower surface of rib 110 thereof. Side walls 106 and 108 have a spacing just slightly greater than the corresponding width of rib 110 so as to restrain movement of the end 28 of bar 22 in the direction normal to the plane of the stirrup, thereby maintaining rib 110 of bar 22 seated on bottom wall 104 of portion 102. Hanger bar 14, side bars 16 and 18, footrest bar 22 and plates 40 and 42 may be fabricated from a suitable structural metal, such as cast aluminum, or plastic having strength characteristics selected to give durable service when subjected to the type of stresses normally accounted in horseback riding.

OPERATION

Figure 3:
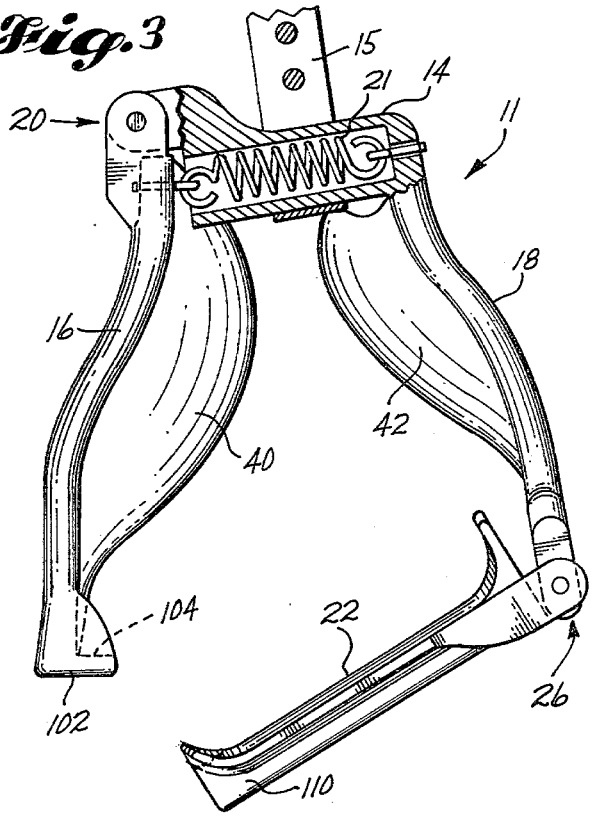
FIG. 3 is another elevation view similar to FIG. 2, but illustrating the safety stirrup of FIG. 1 in a boot releasing condition.

With reference to FIG. 1, a rider's boot is most likely to be caught in a stirrup when he or she falls to one side and to the rear of the horse. In such case, one foot remains, at least momentarily, in its stirrup, and the inevitable twisting and turning of the boot as the rider continues to fall, occassionally causes the boot to become hung up in the stirrup. With reference to FIG. 1, deflector plates 40 and 42 of stirrup 11 react to the upward tilting of boot toe 48 associated with the pivoting of the boot about footrest bar 22, and/or sideways turning of the toe toward or away from the side of the horse, to laterally force apart the associated side bars 16 and 18. The pivotally mounted side bar 16, which is on the outside of the stirrup from the horse, is thereby forced laterally outwardly, pivoting about connection 20. With reference to FIG. 2, as side bar 16 is swung outwardly against the bias of spring 21, the channel-shaped portion 102 of catch 32 is slid out from under the seated end of rib 110 of footrest bar 22 causing bar 22, as shown in FIG. 3, to swing downwardly and away, rotating about pivotal connection 26, and thereby freeing the boot.

To reset stirrup 11, the rider simply spreads side bars 16 and 18 against the spring bias and concurrently lifts the nonpivoted end of footrest bar 22 until rib 110 clears bottom wall 104 of channel-shaped portion 102. Then bar 16 is allowed to be swung inwardly by bias spring 21 until abutment surface 116 contacts stop 114 on the end of bar 22 and rib 110 seats in channel portion 102.

While only a particular embodiment of the invention has been disclosed herein, it will be readily apparent to persons skilled in the art that numerous changes and modifications can be made thereto without departing from the spirit of the invention. For example, although a biasing spring 21 is provided for maintaining an inwardly directed force on side bars 16 and 18 to assist in the retention of footrest bar 22 by catch 32 during normal stirrup use, it is contemplated that side bars 16 may be shaped, weighted and mounted relative to hanger bar 14 and side bar 18 so that gravity provides the necessary inwardly directed biasing of the side bars.

The embodiments of the invention in which an exclusive property or privilege is claimed are defined as follows:

1. In a horseback riding safety stirrup including hangar means by which to suspend the stirrup from a stirrup strap, first and second generally upright side bars, means connecting said side bars at their upper ends to said hangar means and permitting the side bars to swing relatively toward and from each other, a footrest bar disposed transversely between the lower ends of the side bars and joined by one end to the lower end of the first side bar, catch means on the lower end of said second side bar releasably engageable with the opposite end of said footrest bar and when engaged therewith maintaining the footrest bar substantially horizontal, in bridging relation between the lower ends of the side bars which in turn are maintained by the footrest bar in predetermined spaced normal relationship to form an operative rider's stirrup, said catch means being disengageable from the footrest bar by forced relative separation of the side bars, and first and second deflector plates affixed to and projecting forwardly from the respective first and second side bars along a major portion of the length thereof commencing at a level adjacent the level of one foot rest bar, said deflector plates being so formed and relatively positioned with the side bars in their normal relationship so as to converge forwardly from said side bars and also to converge upwardly toward upper protions of said deflector plates, thereby forming a space freely accommodating the toe portion of the rider's foot in normal riding position in the stirrup while reacting to abnormal movement of the foot of a falling rider which wedgingly separates the side bars to release the footrest bar from the catch means as the forward part of the foot including the toe is forced against the plates.

2. The stirrup defined in claim 1 including spring means interacting between the side bars and yieldably urging said side bars toward each other and thereby tending to maintain the catch means engaged with the footrest bar.

3. The stirrup defined in claims 1 or 2 wherein the first-mentioned end of the footrest bar is pivotally connected to the lower end of said first side bar to permit swinging of the footrest bar relative thereto downwardly when disengaged from said catch means.

4. The improvement in the safety stirrup of claim 2, wherein said hangar means comprises a bar of tubular shape defining a generally cylindrical internal chamber, and said biasing means comprises a spring mounted inside said chamber and connected between said first and second side bars.

5. The improvement in the safety stirrup of claim 1, wherein said catch means comprises a shoulder formed on the lower end of said first side bar and projecting laterally inwardly and facing upwardly so as to form a catch surface against which a lower surface portion of said footrest bar seats when said first side bar is in said normal relationship to said second side bar.

6. The improvement in the safety stirrup of claim 1, wherein said deflector plates are generally ear-shaped and said forwardmost extents of said deflector plates are turned laterally outwardly so that the inwardly confronting surfaces of said deflector plates adjacent said forwardmost extents form smooth, continuously contoured, three-dimensional camming surfaces for reliable interaction with the forward part of the rider's boot.

7. In a safety stirrup of the type having an upper, strap supported hanger means, and a pair of laterally spaced apart side bars depending downwardly from said hanger means in which at least a first of said side bars is swingably connected to said hanger means for lateral and outward swinging movement of a lower end of said first side bar relative to said second side bar, and a releasable footrest bar normally bridging the lower ends of said side bars and having a first end pivotally connected for swinging downwardly and away to the lower end of one of said side bars so that the second end of the footrest bar is released from the lower end of the other of said side bars when the lower end of said first side bar is swung laterally and outwardly relative to said second side bar, the improvement comprising first and second deflector plates supportively and fixedly attached along said first and second side bars respectively, said deflector plates projecting inwardly and forwardly from said side bars and being oppositely contoured in a forwardly and upwardly convergent configuration so as to react to excessive upward tilting and/or sideways turning of the forward part of a rider's boot and deflect said first side bar laterally and outwardly relative to said second side bar thereby releasing said footrest bar to swing downwardly and away releasing the rider's boot.

8. The improvement in the safety stirrup of claim 7 wherein said first end of said first end of said footrest bar is pivotally connected to the lower end of said second side bar and further comprising catch means for releasably holding said second end of said footrest bar to the lower end of said first side bar when said first side bar is in a normal, laterally spaced apart position with respect to said second side bar, and for releasing said one end of said footrest bar to effect downward swingaway movement thereof when said first side bar is swung laterally and outwardly from said normal position.

9. The improvement in the safety stirrup of claims 7 or 8 further comprising biasing means for yieldably urging said first side bar laterally inwardly relative to said second side bar to cause said first side bar to assume said normal, laterally spaced apart position with respect to said second side bar.

10. The improvement in the safety stirrup of claim 7, wherein said deflector plates are generally ear-shaped and have rounded forwardmost edges.

11. The improvement in the safety stirrup of claim 10, wherein the marginal portions of said deflector plates along said forwardmost edges are turned laterally outwardly so that the inwardly facing surfaces of said plates form continuously contoured, threedimensional camming surfaces for reliable interaction with the forward part of a rider's boot.

* * * * *

UNITED STATES PATENT AND TRADEMARK OFFICE

CERTIFICATE OF CORRECTION

PATENT NO. : 4,209,962

DATED : July 1, 1980

INVENTOR(S) : Roger C. Forest

It is certified that error appears in the above-identified patent and that said Letters Patent are hereby corrected as shown below:

Column 2, line 36, delete "earshaped" and insert --ear-shaped--.

Column 2, line 65, delete "engaing" and insert --engaging--.

Column 3, lines 6 and 7, delete "folowing" and insert --following--.

Column 3, line 68, delete "descirbed" and insert --described--.

Column 7, line 12, delete "hangar" and insert --hanger--.

Column 7, line 41, delete "for swinging downwardly and away".

Column 8, line 1, after "bars" to read -- for swinging downwardly and away --.

Signed and Sealed this

*Eighteenth* Day of *November 1980*

[SEAL]

*Attest:*

SIDNEY A. DIAMOND

*Attesting Officer*

*Commissioner of Patents and Trademarks*